US005447094A

United States Patent [19]

Geyler, Jr.

[11] Patent Number: 5,447,094

[45] Date of Patent: Sep. 5, 1995

[54] HYDRAULIC SYSTEM FOR BUCKET SELF-LEVELING DURING RAISING AND LOWERING OF BOOM

[75] Inventor: Arthur H. Geyler, Jr., Rockford, Ill.

[73] Assignee: Delta Power Hydraulic Co., Rockford, Ill.

[21] Appl. No.: 192,375

[22] Filed: Feb. 7, 1994

[51] Int. Cl.[6] ..... F15B 11/00; F15B 13/00; B66C 23/00

[52] U.S. Cl. ..... 91/520; 91/535; 414/700

[58] Field of Search ..... 91/508, 511, 517, 520, 91/525, 535; 414/700

[56] References Cited

U.S. PATENT DOCUMENTS

| | | | |
|---|---|---|---|
| 2,988,891 | 6/1961 | Hemings | 91/520 |
| 3,563,137 | 2/1971 | Graber et al. | 91/520 X |
| 3,811,587 | 5/1974 | Seaberg | 414/700 |
| 4,034,649 | 7/1977 | Harvey | 91/517 X |
| 4,085,857 | 4/1978 | Smith | 91/520 X |
| 4,408,518 | 10/1983 | Diel et al. | 91/513 X |
| 4,561,342 | 12/1985 | Calvert | 91/517 X |
| 4,709,618 | 12/1987 | Zongker | 91/513 X |
| 4,723,847 | 2/1988 | Diel et al. | 91/513 X |
| 4,799,851 | 1/1989 | Swanson | 91/520 X |
| 4,923,362 | 5/1990 | Fryk | 91/520 X |
| 5,234,312 | 8/1993 | Hirose | 414/700 |

FOREIGN PATENT DOCUMENTS 2013156 8/1979 United Kingdom ..... 414/700

*Primary Examiner*—John E. Ryznic
*Attorney, Agent, or Firm*—Vernon J. Pillote

[57] ABSTRACT

A hydraulic system having a first bucket leveling circuit for controlling leveling of the bucket during raising of the boom and a second bucket leveling circuit for controlling leveling of the bucket during lowering of the boom. The second bucket leveling circuit includes a motor-type flow divider having first and second shaft connected motor sections. Controls are operative when the boom control valve supplies fluid under pressure to the rod end of the boom cylinder for passing fluid from the piston end of the boom cylinder to the inlet of the first and second sections of the motor-type flow divider, and for preventing passage of fluid from the piston end of the boom cylinder to the inlet of the first flow divider. Although the pressure at the piston end of the boom cylinder is low during lowering of the boom, the motor-type flow divider is operative to supply fluid to the rod end of the bucket cylinder at a pressure that is substantially higher than the pressure at the piston end of the boom cylinder during lowering of the boom, and sufficient to move the bucket at a rate to maintain the latter substantially level.

7 Claims, 2 Drawing Sheets

HYDRAULIC SYSTEM FOR BUCKET SELF-LEVELING DURING RAISING AND LOWERING OF BOOM

BACKGROUND OF INVENTION

The present invention relates to a hydraulic system for controlling movement of the boom and bucket of an end loader.

Various hydraulic systems have heretofore been made for controlling the boom and bucket of an end loader. In the system disclosed in U.S. Pat. No. 3,563,137, fluid exiting from the rod end of the boom cylinder during raising of the boom, passes through a valve type flow divider that dumps a portion to drain while directing the remaining portion to the piston end of the bucket cylinder to level the bucket during raising of the boom. In one embodiment of this patent, the boom control valve was modified to provide a boom-raise and level position and boom-lower and level position, in addition to the customary boom-raise and boom-lower positions. The boom control valve was operative in the boom-lower and level position to pass fluid exiting from the piston end of the boom cylinder during lowering of the boom through a second valve type flow divider arranged to direct one portion of the inlet flow to the rod end of the bucket cylinder and to dump the remaining portion to drain.

Valve type flow dividers divide flow from an inlet into separate streams at two outlets in accordance with the pressure drop through two orifices and can operate reliably only when the pressure at the inlet is substantially greater than the pressure at either outlet. During lowering of the boom, a portion of the fluid from the piston end of the boom cylinder is passed to the rod end of the bucket cylinder. The area of the piston end of the boom cylinder is usually very large as compared to area of the rod end of the bucket cylinder and it has been found that, under some operating conditions, the pressure at the piston end of the boom cylinder is too low as compared to the pressure required at the rod end of the bucket cylinder, to reliably move the bucket when the latter is loaded. Further, in the bucket level system in U.S. Pat. No. 3,563,137, the flow fluid divider valve was arranged to dump a portion of fluid to drain and could not be used with series connected boom and bucket control valves.

U.S. Pat. Nos. 4,408,518; 4,561,342; 4,709,618 and 4,723,478 disclose boom and bucket control systems having a flow divider valve to control bucket leveling during raising of the boom and which are suitable with series connected control valves and parallel connected control valves. However, the systems disclosed in the above patents were not operative to control leveling of the bucket during lowering of the boom.

SUMMARY OF THE INVENTION

An object of the present invention is to provide a hydraulic system for controlling the boom and bucket of an end loader and which is operative to reliably control the leveling of the bucket during lowering of the boom.

Another object of this invention is to provide a boom and bucket control system in accordance with the foregoing object, and which can utilize conventional boom and bucket control valves including control valves having a float position, and which can be used in systems in which the control valves are connected in series or in parallel.

In the present invention, a boom-lower bucket leveling circuit is provided for controlling leveling of the bucket during lowering of the boom. The boom-lower bucket leveling circuit includes a motor-type flow divider having first and second shaft connected motor sections and control means operative when the boom control valve supplies fluid under pressure to the rod end of the boom cylinder for passing fluid from the piston end of the boom cylinder to the inlet sides of the first and second sections of the motor-type flow divider. Although the pressure at the piston end of the boom cylinder is low during lowering of the boom, the motor-type flow divider is operative to supply fluid to the rod end of the bucket cylinder at a pressure that is substantially higher than the pressure at the piston end of the boom cylinder during lowering of the boom, and sufficient to move the bucket at a rate to maintain the bucket substantially level.

A motor-type flow divider can be used in the boom-raise bucket leveling circuit. However, since the pressure at the rod end of the boom cylinder during raising of the boom is substantially higher than the pressure required at the piston end of the bucket cylinder to move the bucket during boom raising, a pressure operated flow divider valve can be used in the boom-raise bucket leveling circuit.

DETAILED DESCRIPTION

Figure 1:
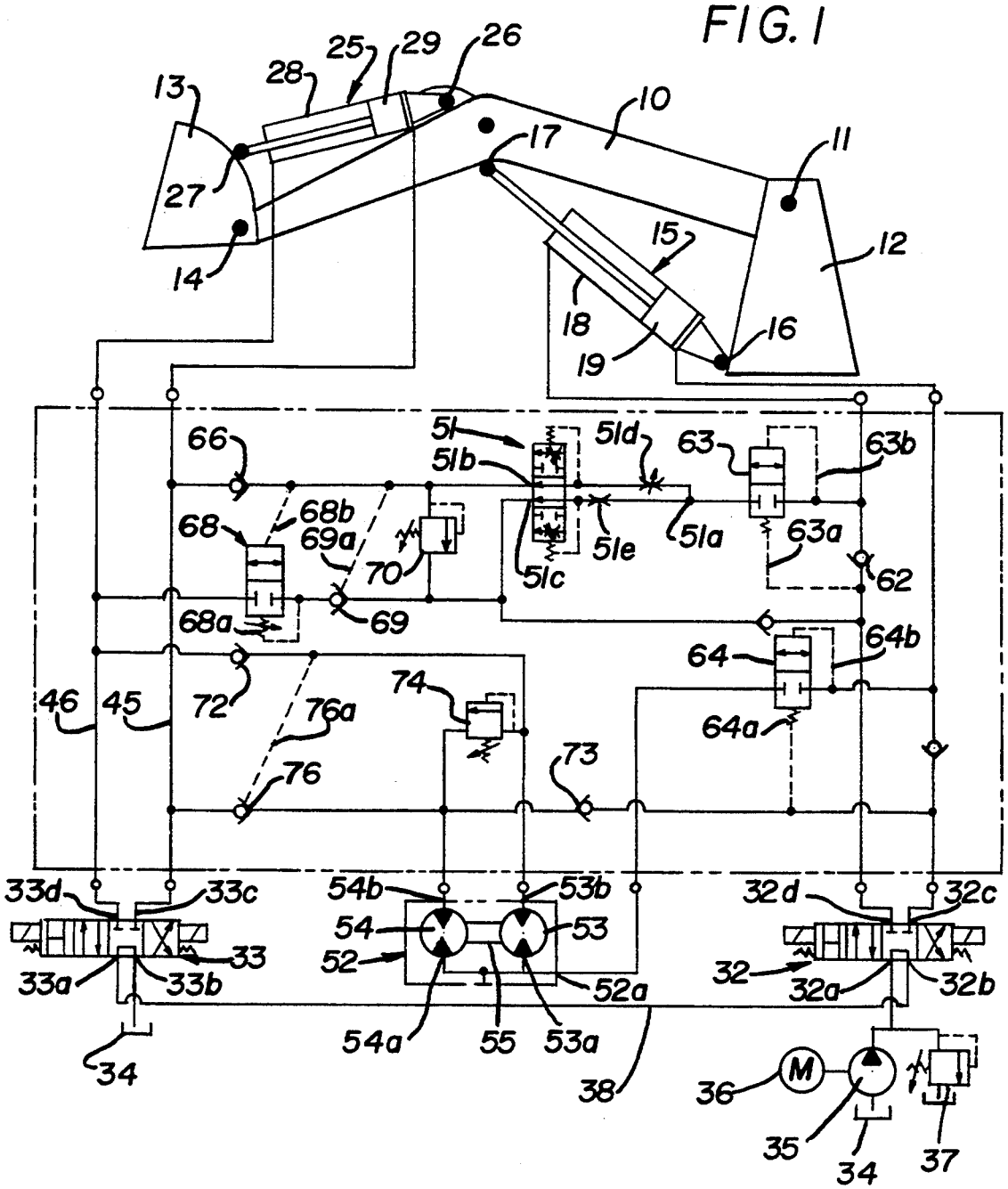
FIG. 1 is a schematic view illustrating a hydraulic circuit for controlling bucket leveling during raising and lowering of the boom on an end loader.

As schematically illustrated in FIG. 1, a boom 10 is pivotally mounted at 11 on a frame member 12 of an end loader, and a bucket 13 is pivoted at 14 on the outer end of the boom. A double acting boom cylinder and piston assembly 15 is pivotally attached at 16 to the frame member 12 and at 17 to the boom 10 to effect raising and lowering of the boom in response to extension and retraction of the piston in the boom cylinder. As is conventional, the boom cylinder and piston assembly includes one or more cylinders 18 and a piston 19 in each cylinder having a rod 21 extending outside the cylinder. A double acting bucket cylinder and piston assembly 25 is pivotally connected at 26 to the boom and at 27 to the bucket to effect dumping and curling of the bucket when the piston is respectively extended and retracted in the cylinder. As is conventional, the bucket cylinder and piston assembly 25 includes one or more cylinders 28 and a piston 29 in each cylinder with a rod 30 attached to the piston and extending out from the cylinder.

A boom control valve 32 is provided for reversibly supplying fluid under pressure to the boom cylinder 15 and a bucket control valve 33 is provided for reversibly supplying fluid to the bucket cylinder 25. The boom control valve has inlet and return ports 32*a* and 32*b* and first and second controlled outlet ports 32*c* and 32*d*. Fluid from a reservoir 34 is pumped under pressure by a pump 35 driven by a motor 36 to the inlet port 32*a*, and a relief valve 37 is provided for controlling the pressure supplied to the inlet port. The bucket control valve 33 also has fluid inlet and return ports 33*a* and 33*b* respectively, and controlled outlet ports 33*c* and 33*d*. In the embodiment illustrated, the boom and bucket control valves are connected in series, that is with the outlet port 32*b* of the boom control valve connected through a passage 38 to the inlet 32*a* of the bucket control valve. The boom and bucket control valves can be connected in parallel, if desired.

Controlled outlet port 32*c* of the boom control valve is connected through a boom-raise passage means 41 to the piston end of boom cylinder 15 and controlled outlet port 32*d* of the boom control valve is connected through a boom-lower passage means 42 to the rod end of the boom cylinder 18. In the neutral position, boom control valve 32*b* blocks the controlled outlet ports 32*c* and 32*d* and the valve is movable to a boom-raise position, to the left as viewed in FIG. 1, to supply fluid under pressure from the pump to the piston end of the boom cylinder, and to a boom-lower position, that is to the right from the neutral position shown in FIG. 1, to supply fluid under pressure to the rod end of the boom cylinder 15. Controlled outlet port 33*c* of the bucket control valve 33 is connected through a bucket dump passage 45 to the piston end of the bucket cylinder 25, and the controlled outlet port 33*d* is connected to the rod end of the bucket cylinder to respectively extend the piston 29 when valve 33 is moved to a dump position, and to retract the piston in the cylinder 25, when the valve is moved to a curl position. The outlet 33*d* of valve 33 is herein shown communicating with reservoir 34, it being understood that the outlet 33*d* could be connected to further control valves.

A boom-raise bucket leveling circuit is provided for controlling passage of fluid from the rod end of the boom cylinder to the piston end of the bucket cylinder to effect leveling of the bucket during raising of the boom. A boom-lower bucket leveling circuit is provided for controlling the flow of fluid from the piston end of the boom cylinder to the rod end of the bucket cylinder to control leveling of the bucket during lowering of the boom. The pressure at the rod end of the boom cylinder is high as compared to the pressure required at the piston end of the bucket cylinder to move the bucket during raising of the boom, and the boom-raise bucket leveling circuit can use a valve type flow divider 51 having an inlet 51*a* and controlled outlets 51*b* and 51*c*. The valve type flow divider has two orifices 51*d* and 51*e* and valve spools operated in response to the pressure at the outlet of restrictors 51*d* and 51*e* to split the flow from the inlet into two streams correlative with the relative flow areas of orifices 51*d* and 51*e*. One of the orifices 51*d* is advantageously made adjustable to adjust the flow at the controlled outlet 51*b* relative to the flow at outlet 51*c*.

A valve-type flow divider can only operate when the pressure at the inlet is substantially above the pressure at the outlets. During lowering of the boom, the pressure at the rod end of the boom cylinder is low and frequently insufficient when applied to the piston end of the bucket cylinder, to effect movement of a loaded bucket to maintain the bucket substantially level. The boom-lower leveling circuit includes a motor-type flow divider 52 having first and second motor sections 53 and 54 connected by a shaft 55 for rotation in unison. The motor sections are preferably of the inter engaging gear type and motor section 53 has an inlet 53*a* and an outlet 53*b* and motor section 54 has an inlet 54*a* and an outlet 54*b*. Inlets 53*a* and 54*a* are connected together to a common flow divider inlet 52*a* and the motor sections 53 and 54 are arranged to divide the inlet flow into first and second outlet streams correlative with the relative volumetric displacements of the first and second motor sections.

The motor-type flow divider is herein provided to meter flow to the rod end of the bucket cylinder having an area $A_1$ from the piston end boom cylinder having an area $A_2$. The area $A_1$ is less than $A_2$ and the ratio of the volumetric displacement of the first and second motor sections is made about $A_1/A_2$.

A first control means is operative when the boom control valve supplies fluid under pressure through the boom-raise passage means 41 to the piston end of the boom cylinder 15, for passing fluid from the rod end of the boom cylinder to the inlet 51*a* of the first flow divider means 51, and for also preventing passages of fluid from the piston end of the boom cylinder to the inlet 52*a* of the motor-type flow divider means 52. Check valves 61 and 62 are provided in the boom-raise and boom-lower passage means 41 and 42, respectively, with their inlet sides respectively communicating with controlled outlet ports 32*c* and 32*d* of the boom control valve 32, and with the outlet sides of the check valves respectively communicating with the piston and rod ends of the boom cylinder 15. The inlet 51*a* of the flow divider 51 communicates through a pressure operated two-position logic valve 63, with the passage 42 between the outlet side of check valve 62 and the rod end of the boom cylinder. Valve 63 is normally spring biased to a position blocking flow from the rod end of the boom cylinder to the inlet flow divider valve 51 and valve 63 is arranged to open when the pressure at the outlet side of the check valve 62 exceeds the pressure at the inlet side of valve 62. One pilot pressure line 63*a* supplies pressure from the inlet side of check valve 62 to valve 63 in a direction to urge that valve to a closed position and a second pilot line 63*b* applies pressure at the outlet side of the check valve 62 to valve 63 in a direction to move valve 63 to an open position. Thus, when the pressure at the outlet side of check valve 62 exceeds the pressure at the inlet side of valve 62, valve 63 is pressurized to an open position by a pilot pressure line 63*b* that communicates with the passage 42 at the outlet side of check valve 62. Similarly, the inlet 52*a* of motor-type flow divider 52 is connected through a pressure operated logic valve 64 to passage 41 at the outlet side of check valve 61 leading to the piston end of the boom cylinder. Valve 64 is a pressure operated two-position logic valve of the same type as valve 62 and is normally spring biased closed and is operative to open when the pressure at the outlet side of the check valve 61 is greater than the pressure at the inlet side. Valve 64 has one pilot line 64*a* that communicates with the passage 41 between the inlet side of check valve 61 and the controlled outlet port 32*c* of the boom control valve and a second pilot line 64*b* that communicates with passage 41 between the outlet side of the check valve 61 and the piston end of the boom cylinder. Thus, when the boom control valve 32 is moved to its raise position and supplies fluid under pressure to port 32*c*, check valve 61 opens to pass fluid to the piston end of the boom cylinder. Check valve 62 closes to block flow back to the return port 32*d* of the boom control valve, and valve 63 is pressure operated to its open position to pass the fluid from the rod end of the boom cylinder to the inlet of the flow divider 51. As previously described, flow divider 51 divides flow from the inlet into first and second outlet streams and the first outlet stream at outlet port 51*a* is passed through a check valve 66 to the bucket dump passage 45 leading to the piston end of the bucket cylinder 25 at a rate to maintain the bucket generally level when raising the boom. The second outlet stream from port 51*c* of flow divider 51 is passed through check valve 67 to the passage 42 at a location to return fluid to the controlled outlet port 32*d* of the boom control valve 32. Accordingly, when the boom control valve 32 is in its boom-raise position, fluid from the rod end of the boom cylinder is passed through the flow divider 51 and one stream from the flow divider is passed to the piston end of the bucket cylinder and the other stream from the flow divider is returned to the port 32*d* of boom control valve.

The bucket control valve 33 in its neutral position, blocks return flow from the rod end of the bucket cylinder, and a provision is made for returning flow from the rod end of the bucket cylinder to the outlet port 32*d* of the boom control valve 32. For this purpose, passage 46 is connected to a bucket return passage including pilot operated sequence valve 68, a pilot operated check valve 69 and check valve 67 to the outlet 32*d* of the boom control valve. A pressure relief valve 70 has an inlet connected to the first outlet 51*b* of flow divider valve 51, and an outlet connected to the return passage at location between the check valves 69 and 67. Check valve 69 is normally closed to block return flow from the rod end of the bucket cylinder and has an external pilot passage 69*a* connected to the outlet 51*b* of the flow divider 51 to open the check valve 69 in response to pressure at the outlet 51*b*. The pressure relief valve 70 is of the adjustable type and set to open at a pressure above that required for normal operation of the bucket, such as occurs when the bucket piston reaches the end of its stroke. Valve 68 is a pilot operated sequence valve that is normally closed by a spring 68*a* and pilot operated to an open position through a pilot passage 68*b* connected to the outlet 51*b* of the flow divider valve 51. The spring is arranged to maintain the valve closed until the pressure at the piston end of the bucket cylinder exceeds a preselected minimum pressure for operating the bucket, and valve 68 progressively opens as the pressure at the piston end of the bucket cylinder increases relative to the pressure at the rod end of the bucket cylinder to maintain a positive pressure differential therebetween and limit the speed of movement of the piston in the bucket cylinder.

Port 53*b* of the motor-type flow divider is connected through a check valve 72 to the bucket curl passage 46. Check valve 72 is arranged to open to pass fluid to the through passage 46 to the rod end of the bucket cylinder and to close to prevent return flow. Port 54*b* of the motor-type flow divider is connected through a return passage including check valve 73 that communicates with the outlet port 32*c* of the boom control valve, and check valve 73 is arranged to open for flow to the port 32*c* and to close to prevent return flow. A relief valve 74 has an inlet connected to receive fluid from the port 53*b* in the motor-type flow divider 52 and the relief valve has its outlet connected through check valve 73 to the passage leading to the controlled outlet 32*c* of boom control valve 32. Bucket dump passage 45 is connected through a return passage including a pilot operated check valve 76 and check valve 73 to the controlled outlet port 32*c* of the boom control valve. Valve 76 is normally closed to block return from the piston end of the bucket cylinder and has a pilot line 76*a* communicating with the outlet 53*b* of the motor-type flow divider, to open valve 76 and allow flow from the piston end of the bucket cylinder through check valve 73 to the controlled outlet port 32*c* of the boom control valve 32. Thus, when the boom control valve 32 is moved to its boom-lower position supplying pressure to port 32*d*, pressure operated two-position valve 64 is opened to pass fluid from the rod end of the boom cylinder to the inlet 52*a* of the motor-type flow divider. Flow divider 52 divides the flow into a first stream at outlet 53*b* and delivers this stream through check valve 72 to the rod end of the bucket cylinder to move the bucket in a curl direction at a rate to maintain the bucket substantially level as the boom is lowered. Check valve 76 is pressure operated to an open position in response to pressure at the outlet of the first flow divider section, to return fluid from the piston end of the bucket cylinder through check valve 73 to the outlet port 32*c* of the boom control valve 32.

In the hydraulic system shown in FIG. 1, the second stream from the first flow divider valve is returned to the controlled outlet port 32*d* of the boom control valve so that, when the boom control valve is in its boom-raise position, fluid will be supplied from port 32*b* through the transfer passage 38 to the inlet port 33*a* of the bucket control valve and thus enable selective operation of the bucket by the bucket control valve during raising of the boom. When the boom control valve is in its boom-lower position, fluid from the second section 54 of the motor-type flow divider 52 is returned to the outlet port 32*c* of the boom control valve and can flow through port 32*b* and the transfer passage 38 to the inlet of the bucket control valve so that the bucket can also be selectively operated during boom lowering. It is also desirable in some applications to have control valves with a "float" position, that is a position in which the controlled outlet ports are communicated with each other and with the inlet and return ports of the valve as schematically illustrated at the left ends of valves 32 and 33 in FIG. 1. Check valves 61 and 62 in the boom-raise and boom-lower passages would inhibit floating of the boom when the boom control valves are in a float position. However, the two-position logic valves 63 and 64 are operative to effectively by-pass check valves 61 and 62 through the associated flow divider when the boom control valve is in a float position. Thus, when the boom control valve is in a float position, outlet ports 32*c* and 32*d* communicate with each other and with the inlet ports 32*a* and 32*b*. When the boom is pressed upwardly by the terrain, the lower pressure at the piston end of the boom cylinder causes check valve 61 to open and supply fluid to the piston end of the boom cylinder and the increase in pressure at the rod end of the boom cylinder causes the two-position logic valve to open and pass fluid to the flow divider valve 51 and through outlet 51*c* and check valve 67 back to port 32*c* of the boom control valve. Similarly, when the boom moves downwardly to conform to the terrain, the lower pressure at the rod end of the boom cylinder causes check valve 62 to open and supply fluid to the rod end of the cylinder and the higher pressure at the piston end of the boom cylinder opens two-position logic valve 64 and passes fluid from the piston end of the boom cylinder through section 54 of the flow divider 52 and through check valve 73 to the boom control valve.

Figure 2:
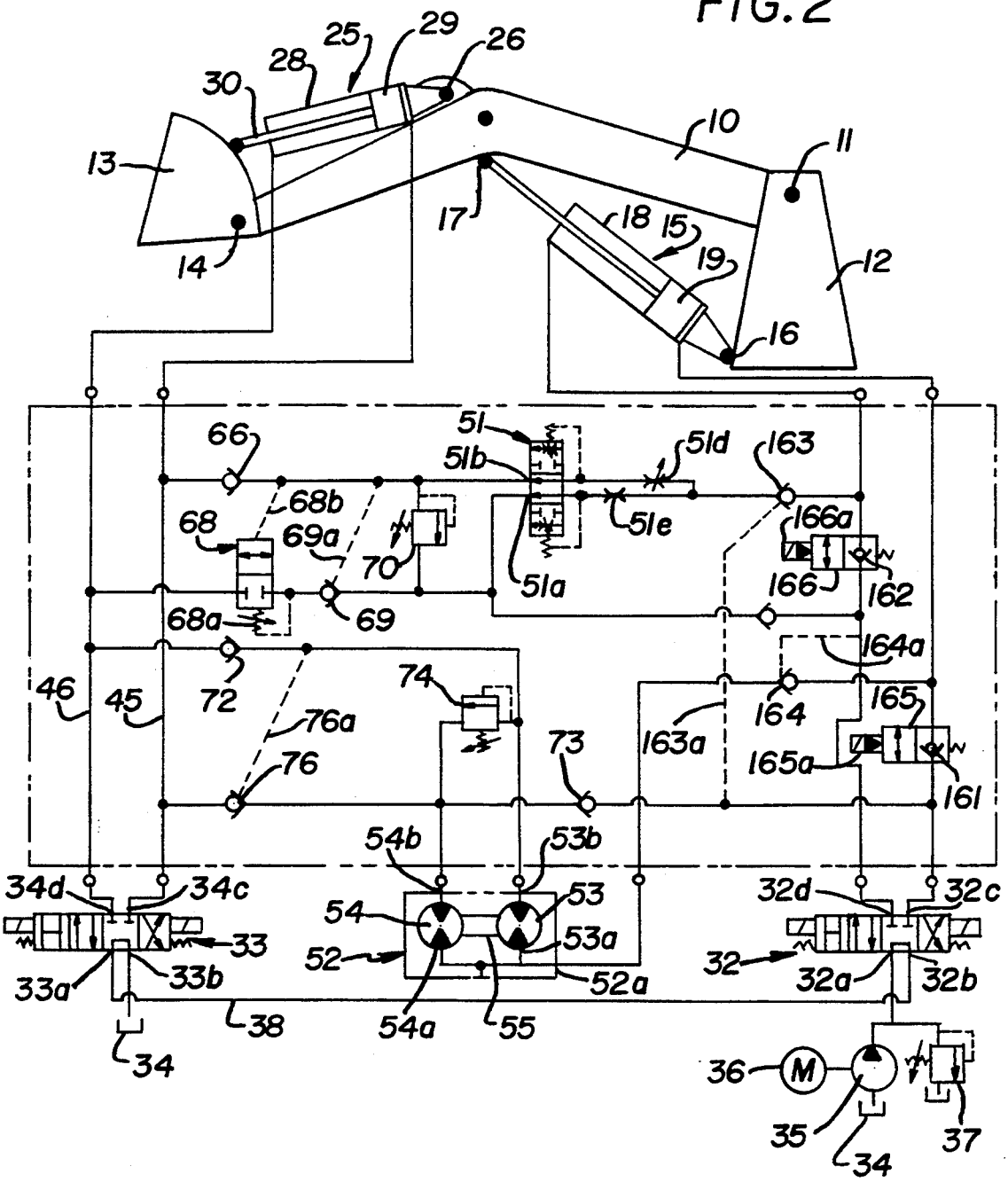
FIG. 2 is a diagrammatic view illustrating a modified hydraulic system for controlling bucket leveling during raising and lowering of the boom on an end loader.

The embodiment of FIG. 2 is in general the same as that of FIG. 1 and like numerals are used to designate the same parts and like numerals in the 100 series are used to designate modified parts. As in the preceding embodiment, check valves 161 and 162 in the boom-raise and boom-lower passages, have their inlet sides communicating with the respective control ports 32*c* and 32*d* of the boom control valve, and their outlet sides are respectively connected to the piston end and rod end of the boom cylinder 15. A pilot operated check valve 163 is provided for controlling flow from the rod end of the boom cylinder 15 to the inlet 51*a* of the flow divider 51, and a pilot operated check valve 164 is provided for controlling flow from the piston end of the boom cylinder 15 to the inlet 52*a* of the motor-type flow divider 52. Valve 163 is normally closed and is pressure operated through pilot line 163*a* that communicate with the boom-raise passage 41 at the inlet side of check valve 16. Similarly, Valve 164 is normally closed and is pressure operated to an open position through pilot line 164*a* that communicates with the boom-lower passage 41*b* inlet side of the check valve 162.

When the boom control valve 32 is moved to its boom-raise position, fluid is supplied to outlet port 32*c* and flows through check valve 161 to the piston end of the boom cylinder 15. Check valve 162 blocks return flow to the outlet port 32*d* of the boom control valve and pressure at the outlet side of the check valve 162 is applied to valve 163 and moves the latter to an open position so that fluid flows from the rod end of the boom cylinder to the inlet of the flow divider 51. As described in connection in the preceding embodiment, fluid at the controlled outlet port 51*b* of the flow divider 51 is supplied through check valve 66 to the piston end of the bucket cylinder 25. Return flow from the rod end of the bucket cylinder is controlled by a sequence valve 68 and check valve 69.

When the boom control valve 32 is moved to its boom-lower position, fluid under pressure is supplied to the outlet port 32*d* and flows through check valve 162 to the rod end of the boom cylinder. Check valve 161 closes and fluid pressure at the inlet side of the check valve 162 is applied through pilot line 164*a* to valve 164 to move it to an open position and thereby pass fluid from the piston end of the boom cylinder to the inlet end of the motor-type flow divider 52. The motor-type flow divider divides the inlet flow into two streams and the first stream at outlet of motor section 53*b* is passed through check valve 72 to the rod end of the bucket cylinder at a rate to move the bucket in a direction to maintain it generally level during lowering of the boom. Fluid from the piston end of the bucket cylinder flows through pilot operated check valve 76 and check valve 73 to the controlled outlet port 32*c* of the boom control valve. Although the pressure at the piston end of the boom cylinder is relatively low during lowering of the boom, fluid flowing through the second motor section 54 of the motor-type flow divider through check valve 73 to the controlled outlet port 32*c*, causes motor section 54 to drive the motor section 53 and thereby increase the pressure supplied through outlet port 53*b* to the rod end of the bucket cylinder, and thereby provide sufficient force to move the bucket and maintain the bucket generally level during lowering of the boom.

When the boom control valve is moved to its float position and communicates controlled outlet ports 32*c* and 32*d* with each other and with the inlet return ports 32*a* and 32*b*, the check valves 161 and 162 can open for flow therethrough in a direction to the associated end of the boom cylinder, but close to prevent return flow. Valves 165 and 166 are provided for by-passing check valves 161 and 162 respectively and have selectively operable actuators such as electro-responsive actuators 165*a* and 166*a* respectively so that the valves can be selectively actuated to an open position to by-pass the respective check valves 161 and 162 when the boom control valve is moved to the float position. As schematically illustrated in FIG. 2, check valves 161 and 162 can conveniently be built into and form a part of valves 165 and 166 respectively.

The embodiments of the invention in which an exclusive property or privilege is claimed are defined as follows:

1. A hydraulic system for controlling a boom and bucket comprising:

a) a double acting boom cylinder and piston assembly, a boom control valve having a neutral position and at least a boom-raise and a boom-lower positions, boom-raise passage means for supplying fluid under pressure from a first port of the boom control valve means to a first end of the boom cylinder when the boom control valve is in the boom-raise position and boom-lower passage means for supplying fluid pressure from a second port of the boom control valve to a second end of the boom cylinder when the boom control valve is in the boom-lower position, b) a double acting bucket cylinder and piston assembly and a bucket control valve having a neutral position and at least a curl position and a dump position, bucket dump passage means for supplying fluid pressure from a first port of the bucket control valve to a first end of the bucket cylinder when the bucket control valve is in the dump position and for supplying fluid under pressure from a second port of the bucket control valve to a second end of the bucket cylinder when the bucket control valve is in the curl position, c) a boom-raise bucket leveling circuit including a first flow divider means for dividing flow from an inlet into first and second outlet streams, and passage means for passing the first outlet stream to the first end of the bucket cylinder and for passing the second outlet stream to the second port of the boom control valve, d) a boom-lower bucket leveling circuit means including a motor-type flow divider means having first and second shaft connected motor sections each having an inlet side and an outlet side, the first motor section having a smaller volumetric displacement than the second motor section and passage means for passing a first outlet stream from the outlet side of first motor section to the second end of the bucket cylinder and for passing a second outlet stream from an outlet side of second motor section to the first port in the boom control valve, e) first control means operative when the boom control valve supplies fluid under pressure through the boom-raise passage means to the first end of the boom cylinder for:

(i) passing fluid from the second end of the boom cylinder to the inlet of the first flow divider means and, (ii) preventing passage of fluid from the boom-raise passage means to the inlet of the motor-type flow divider means;

f) second control means operative when the boom control valve supplies fluid under pressure through the boom-lower passage means to the second end of the boom cylinder for:

(i) passing fluid from the first end of the boom cylinder to the inlet side of the first and second sections of the motor-type flow divider means, and (ii) preventing passage of fluid from the boom-lower passage means to the inlet of the first flow divider means.

2. A hydraulic system according to claim 1 wherein cross-sectional area of the piston in the bucket cylinder at said second end is $A_1$ and the net cross-sectional area of the piston in the boom cylinder at said first end is $A_2$ and the ratio of the volumetric displacement of the first motor section to the volumetric displacement of the second motor section is about $A_1/A_2$.

3. A hydraulic system according to claim 1 wherein the second end of the bucket cylinder is the rod end and the rod end of the bucket piston has a net cross-sectional area $A_1$, the first end of the boom cylinder is the piston end and the boom piston has a net cross-sectional area $A_2$, and the ratio of the volumetric displacement of the first motor section to the second motor section is about $A_1/A_2$.

4. A hydraulic system according to claim 1 wherein said first control means .includes first check valve in the boom-lower passage means having an inlet side communicating with the second port of the boom control valve and an outlet side communicating with the second end of the boom cylinder, said second control means including a second check valve in the boom-raise passage means having an inlet side communicating with the first port in the boom control valve and an outlet side communicating with the first end of boom cylinder.

5. A hydraulic system according to claim 1 wherein said first control means includes a first check valve in the boom-lower passage means having an inlet side communicating with the second port of the boom control valve and an outlet side communicating with the second end of the boom cylinder, and first pressure operated valve means for controlling flow from the second end of the boom cylinder to the inlet of the first flow divider means, the first pressure operated valve means having means responsive to pressure at the inlet and the outlet sides of said first check valve means for moving said first pressure operated valve means to an open position when the pressure at the outlet side of the first check valve means is greater than the pressure at the inlet side of the first check valve means and for moving he first pressure operated valve means to a closed position when the pressure at the inlet side of the first check valve means is greater than the pressure at the outlet side of the first check valve means, said second control means including a second check valve in the boom-raise passage means having an inlet side communicating with the first port of the boom control valve and an outlet side communicating with the first end of the boom cylinder, and normally closed second pressure operated valve means for controlling flow from the first end of the boom cylinder to the inlet of the motor-type first flow divider means, the second pressure operated valve means having means responsive to pressure at the inlet and outlet sides of said second check valve means for moving said second pressure operated valve means to an open position when the pressure at the outlet side of the second check valve means is greater than the pressure at the inlet side of the second check valve means and for moving said second pressure operated valve means to a closed position when the pressure at the inlet side of the second check valve means is greater than the pressure at the outlet side of the second check valve means.

6. A hydraulic system according to claim 1 wherein said first control means includes a first check valve means in the boom-lower passage means having an inlet side communicating with the second port of the boom control valve and an outlet side communicating with the second end of the boom cylinder, first selectively actuatable valve means for by-passing said first check valve means, and normally closed first pressure operated valve means for controlling flow from the second end of the boom cylinder to the inlet of the first flow divider means, the first pressure operated valve means having means responsive to the pressure at the first port of the boom control valve means for moving the first pressure operated valve means to an open position when the boom control valve is in the boom-raise position, said second control means including a second check valve means in the boom-raise passage means having an inlet side communicating with the second outlet port of the boom control valve and an outlet side communicating with the first end of the boom cylinder, second selectively actuatable valve means for by-passing said second check valve means, and normally closed second pressure operated valve means for controlling flow from the first end of the boom cylinder to the inlet of the inlet of the motor-type flow divider means, the second pressure operated valve means having means responsive to the pressure at the first port of the boom control valve for moving the second pressure operated valve to an open position, and means for actuating said first and second selectively actuatable valve means to position by-passing the respective first and second check valve means.

7. A hydraulic system for controlling a boom and bucket comprising:

a) a double acting boom cylinder and piston assembly, a boom control valve having a neutral position and at least a boom-raise and a boom-lower position, boom-raise passage means for supplying fluid under pressure from a first port of the boom control valve means to a first end of the boom cylinder when the boom control valve is in the boom-raise position and a boom-lower passage means for supplying fluid pressure from a second port of the boom control valve to a second end of the boom cylinder when the boom control valve is in the boom-lower position, b) a double acting bucket cylinder and piston assembly and a bucket control valve having a neutral position and at least a curl position and a dump position, bucket dump passage means for supplying fluid pressure from a first port of the bucket control valve to a first end of the bucket cylinder when the bucket control valve is in the dump position and for supplying fluid under pressure from a second port of the bucket control valve to a second end of the bucket cylinder when the bucket control valve is in the curl position;

c) wherein the second end of the bucket cylinder is the rod end and the rod end of the bucket piston has a net cross-sectional area $A_1$, the first end of the boom cylinder is the piston end and the piston end of the boom cylinder has a net cross-sectional area $A_2$, and $A_1$ is less than $A_2$;

d) a boom-lower bucket leveling circuit means including a motor-type flow divider means having first and second shaft connected motor sections each having an inlet side and an outlet side, the first motor section having a volumetric displacement less than the volumetric displacement of the second motor section and passage means for passing a first outlet stream from the outlet side of first motor section to the second end of the bucket cylinder, the ratio of the volumetric displacement of the first motor section to the second motor section being about $A_1/A_2$; and e) control means operative when the boom control valve supplies fluid under pressure through the boom-lower passage means to the second end of the boom cylinder for passing fluid from the first end of the boom cylinder to the inlet side of the first and second sections of the motor-type flow divider means.

* * * * *